US009039008B2

(12) United States Patent
Anezaki

(10) Patent No.: US 9,039,008 B2
(45) Date of Patent: May 26, 2015

(54) SHEET PROCESSING APPARATUS AND IMAGE FORMING SYSTEM

(71) Applicant: KONICA MINOLTA, INC., Chiyoda-ku, Tokyo (JP)

(72) Inventor: Tsutomu Anezaki, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/140,378

(22) Filed: Dec. 24, 2013

(65) Prior Publication Data

US 2014/0175736 A1 Jun. 26, 2014

(30) Foreign Application Priority Data

Dec. 26, 2012 (JP) ..... 2012-282096

(51) Int. Cl.
*B65H 9/00* (2006.01)
*B65H 31/34* (2006.01)
(Continued)

(52) U.S. Cl.
CPC ..... *B65H 9/00* (2013.01); *B65H 31/34* (2013.01); *B65H 31/26* (2013.01);
(Continued)

(58) Field of Classification Search
CPC ..... B65H 9/00; B65H 5/228; B65H 9/106; B65H 9/166; B65H 9/06; B65H 11/007; B65H 5/24; B65H 2801/21
USPC ..... 271/234, 236–240
See application file for complete search history.

(56) References Cited

U.S. PATENT DOCUMENTS 6,527,269 B2 * 3/2003 Yamada et al. ..... 271/221
8,123,215 B2 * 2/2012 Kanda ..... 271/244
(Continued)

FOREIGN PATENT DOCUMENTS

JP 2003261261 A 9/2003
JP 2008-115010 A 5/2008
(Continued)

OTHER PUBLICATIONS

Japanese Office Action dated Feb. 24, 2015, issued in counterpart Japanese Application No. 2012-282096.
(Continued)

*Primary Examiner* — Prasad Gokhale
(74) *Attorney, Agent, or Firm* — Holtz, Holtz, Goodman & Chick PC

(57) ABSTRACT

A sheet processing apparatus, including: a stacking section; a first alignment section which aligns both end portions in a sheet conveyance direction of the sheet stacked in the stacking section; a second alignment section which aligns both end portions in a width direction, that is orthogonal to the sheet conveyance direction, of the sheet aligned by the first alignment section; a sheet ejection section which ejects the sheet stacked in the stacking section outside the stacking section; and a control section which moves a pair of horizontal alignment plates away from the both end portions in the width direction of the sheet after operating a gripping section so as to grip the sheet in a state where the pair of horizontal alignment plates contacts the both end portions in the width direction of the sheet supported by a supporting section.

6 Claims, 14 Drawing Sheets

(51) Int. Cl.

| | |
|---|---|
| ***B65H 31/26*** | (2006.01) |
| ***B65H 9/06*** | (2006.01) |
| ***B65H 31/02*** | (2006.01) |
| ***B65H 31/20*** | (2006.01) |
| ***B65H 31/30*** | (2006.01) |
| ***G03G 15/00*** | (2006.01) |
| ***B42C 1/12*** | (2006.01) |

(52) U.S. Cl.

CPC ..... B65H 9/06 (2013.01); *B65H 31/02* (2013.01); *B65H 31/20* (2013.01); *B65H 31/3027* (2013.01); *B65H 2301/42146* (2013.01); *B65H 2301/4227* (2013.01); *B65H 2301/4229* (2013.01); *B65H 2301/5126* (2013.01); *B65H 2801/48* (2013.01); *G03G 15/6541* (2013.01); *B42C 1/12* (2013.01)

(56) References Cited

U.S. PATENT DOCUMENTS

| | | | | |
|---|---|---|---|---|
| 2008/0006993 | A1* | 1/2008 | Nomura et al. | 271/240 |
| 2008/0106032 | A1 | 5/2008 | Kanda | |
| 2009/0014950 | A1* | 1/2009 | Mizutani et al. | 271/306 |
| 2010/0254782 | A1* | 10/2010 | Yonekawa et al. | 412/35 |
| 2011/0233858 | A1* | 9/2011 | Uchiyama et al. | 271/234 |

FOREIGN PATENT DOCUMENTS

| | | | |
|---|---|---|---|
| JP | 2008120517 | A | 5/2008 |
| JP | 2012218900 | A | 11/2012 |

OTHER PUBLICATIONS

Japanese Office Action dated Dec. 16, 2014, issued in counterpart Japanese Application No. 2012-282096.

* cited by examiner

SHEET PROCESSING APPARATUS AND IMAGE FORMING SYSTEM

BACKGROUND OF THE INVENTION

1. Field of the Invention

The present invention relates to a sheet processing apparatus and an image forming system.

2. Description of Related Art

Conventionally, there have been known sheet processing apparatuses which stack and align a predetermined number of sheets of paper on which images are formed by an image forming apparatus, and perform post-processing such as folding, binding and trimming on the sheets to form booklets.

In such sheet processing apparatuses, there has been known a configuration which is provided with a stacking section to stack a predetermined number of following sheets during the folding or binding.

It has been known to provide a stacking section with a vertical alignment member which aligns the ends in the conveyance direction of stacked sheets and a pair of width alignment plates which aligns the ends in the width direction orthogonal to the conveyance direction of the sheets that are aligned by the vertical alignment member provided in the stacking section. The pair of width alignment plates presses the both ends in the width direction of the sheets to align the width direction of the sheets at the same time or after the vertical alignment (for example, see Japanese Patent Application Laid Open Publication No. 2008-115010).

Generally, in the width alignment operation of sheets as described above, both ends in the width direction of sheets are pressed by the pair of horizontal alignment plates approaching each other so as to have a slightly smaller interval than the sheet width, and thus the width alignment can be performed firmly even when there are gaps in width among the individual sheets.

However, sheet processing apparatuses which perform such width alignment operation have a problem that the sheets bounce due to the rebound when the pair of horizontal alignment plates is moved away from the sheets after the width alignment operation and a gap occurs between the central position in the width direction of the conveyance path and the central position in the width direction of the sheets.

SUMMARY OF THE INVENTION

The present invention has been made in consideration of the above problems in conventional techniques, and an object of the present invention is to provide a sheet processing apparatus and an image forming system which can prevent the central position in the width direction of sheets from shifting from the central position in the width direction of the conveyance path after performing width alignment operation.

In order to achieve the above object, according to one aspect of the present invention, there is provided a sheet processing apparatus, including: a stacking section in which at least one sheet of paper conveyed from upstream is stacked; a first alignment section which aligns both end portions in a sheet conveyance direction of the sheet stacked in the stacking section; a second alignment section which aligns both end portions in a width direction, that is orthogonal to the sheet conveyance direction, of the sheet aligned by the first alignment section; a sheet ejection section which ejects the sheet stacked in the stacking section outside the stacking section; and a control section which moves a pair of horizontal alignment plates away from the both end portions in the width direction of the sheet after operating a gripping section so as to grip the sheet in a state where the pair of horizontal alignment plates contacts the both end portions in the width direction of the sheet supported by a supporting section, wherein the first alignment section includes: the supporting section which supports a lower end portion in the sheet conveyance direction of the sheet; and the gripping section which grips the sheet at a central portion in the width direction of the sheet supported by the supporting section, and the second alignment section includes the pair of horizontal alignment plates which is provided at positions facing each other to sandwich, along the width direction, the sheet supported by the supporting section and is moved along the width direction to contact and move away from the both end portions in the width direction of the sheet supported by the supporting section.

Preferably, the sheet ejection section includes a pair of conveyance rollers which conveys the sheet stacked in the stacking section outside the stacking section, and the control section releases grip of the gripping section after the pair of conveyance rollers nips the sheet which is gripped by the gripping section.

Preferably, a trimming unit which trims margins at the both end portions in the width direction of the conveyed sheet is provided downstream in the sheet conveyance direction of the sheet ejection section.

Preferably, the gripping section is provided at a position facing a center in the width direction of the pair of horizontal alignment plates.

Preferably, a plurality of gripping sections are provided at positions facing a central portion in the width direction of the pair of horizontal alignment plates.

According to another aspect of the present invention, there is provided an image forming system, including: an image forming apparatus which forms an image on a sheet of paper; and the above sheet processing apparatus which performs predetermined processing on the sheet on which the image is formed by the image forming apparatus.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Hereinafter, an image forming system 1 in an embodiment of the present invention will be described with reference to the drawings.

Figure 1:
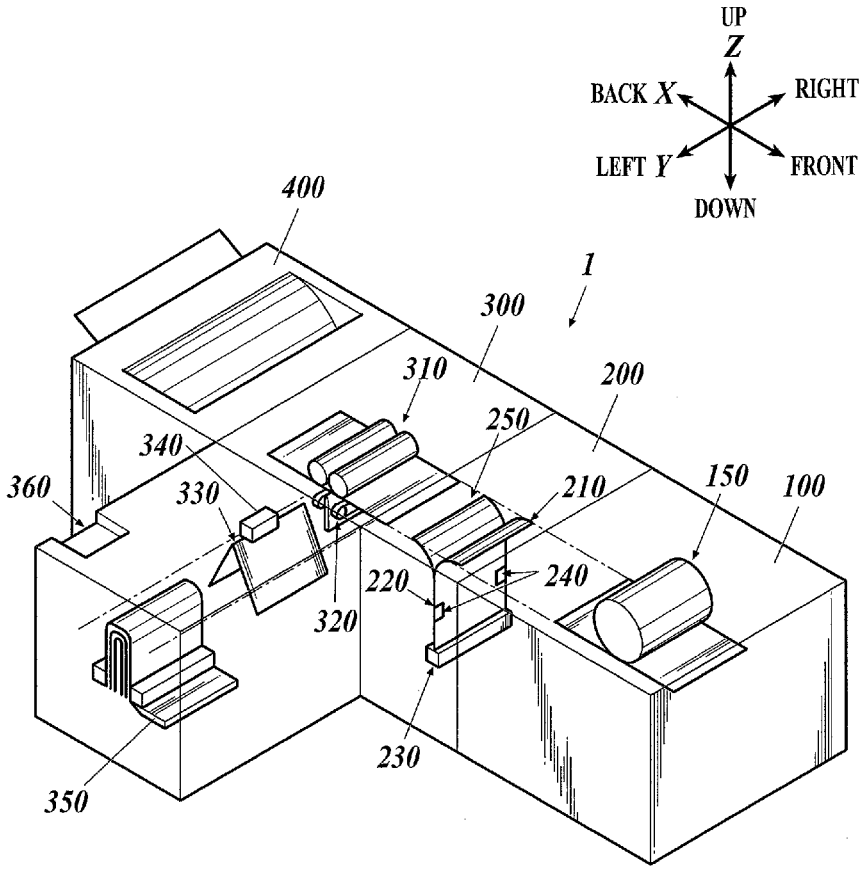
FIG. 1 is a schematic view showing an entire configuration of an image forming system.

FIG. 1 is a schematic view showing an entire configuration of the image forming system 1.

The image forming system 1 includes an image forming apparatus 100, an intermediate conveyance apparatus (sheet processing apparatus) 200, a saddle stitching apparatus 300 and a side stitching apparatus 400.

In the description below, the vertical direction is Z-direction, the direction along the direction in which the image forming apparatus 100, the intermediate conveyance apparatus 200, the saddle stitching apparatus 300 and the side stitching apparatus 400 shown in FIG. 1 are connected to each other is X-direction and the direction orthogonal to the X-direction and the Z-direction is the Y-direction.

The description is made by providing front side and back side in the X-direction. Here, the front side is the upstream side in the sheet conveyance direction in the image forming system 1 and the back side is the downstream side thereof.

The image forming apparatus 100 forms an image on a sheet of paper.

Specifically, the image forming apparatus 100 includes, for example, a conveyance section which draws a sheet of paper stored as a recording medium from a sheet tray and conveys the sheet, a developing section which develops a toner image corresponding to bit map data onto a primary transfer member such as a transfer roller, a primary transfer section which transfers the toner image developed on the primary transfer member onto a secondary transfer member such as a transfer drum 150, a secondary transfer section which transfers the toner image transferred on the secondary transfer member onto the sheet conveyed by the conveyance section, a fixing section which fixes the transferred toner image onto the sheet, an ejection section which ejects the sheet after the fixing processing by the fixing section and such like, and the image forming apparatus 100 forms an image on the sheet.

The image forming apparatus 100 passes the sheet ejected after the image is formed thereon to the intermediate conveyance apparatus 200. That is, in the image forming system 1, the image forming apparatus 100 is connected to the intermediate conveyance apparatus 200 so that the sheet ejected from the image forming apparatus 100 is passed to the intermediate conveyance apparatus 200.

The intermediate conveyance apparatus 200 can convey the sheet to the saddle stitching apparatus 300 after stacking a predetermined number of sheet(s) which is at least one and temporarily standing by.

Figure 2:
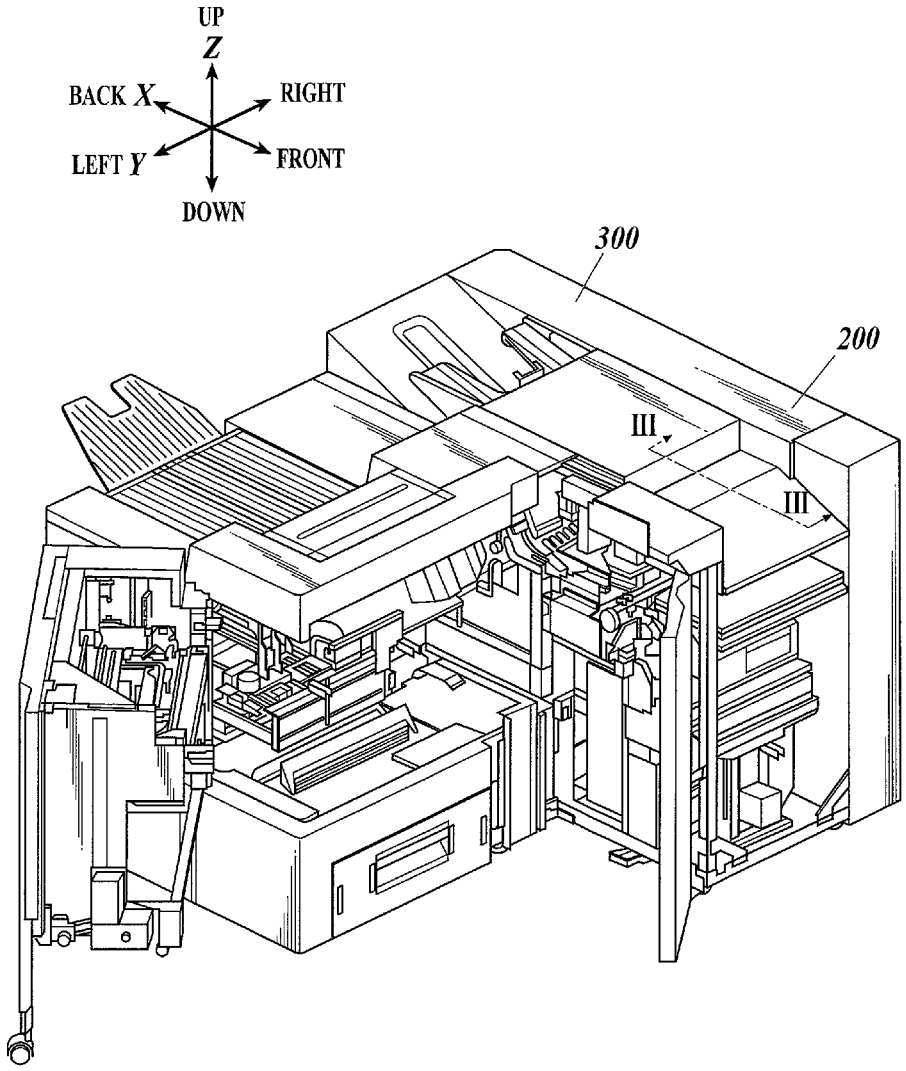
FIG. 2 is a perspective view showing an outer appearance of an intermediate conveyance apparatus and a saddle stitching apparatus.
Figure 3:
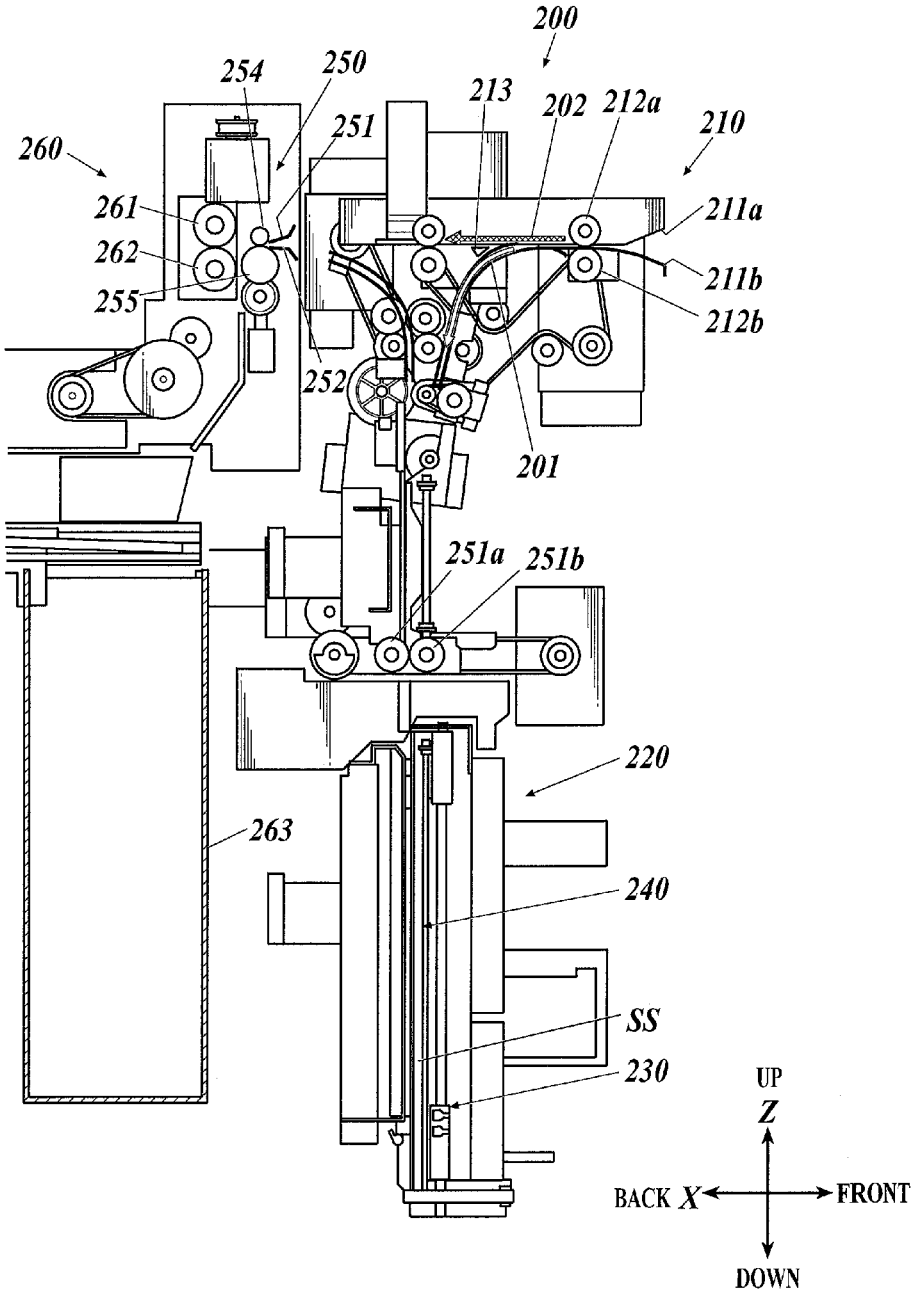
FIG. 3 is a view showing an example of a main configuration inside the intermediate conveyance apparatus and is a sectional view of FIG. 2 cut along the line III-III.

Here, FIG. 2 is a perspective view showing an outer appearance of the intermediate conveyance apparatus 200 and the saddle stitching apparatus 300. FIG. 3 is a view showing an example of a main configuration inside the intermediate conveyance apparatus 200 and is a sectional view of FIG. 2 cut along the line III-III.

The intermediate conveyance apparatus 200 includes a receiving section 210 which receives sheets passed from the image forming apparatus 100 one by one, an stacking section (stacker) 220 which stacks a predetermined number (at least one) of sheets received by the receiving section 210, a first alignment section 230 which aligns the both end portions in the sheet conveyance direction of the sheets (vertical both end portions of the sheet) stacked in the stacking section 220, a second alignment section 240 which aligns both end portions (i.e. both side edges in the horizontal direction of the sheet) in the width direction orthogonal to the sheet conveyance direction of the sheets aligned by the first alignment section 230, a sheet ejection section 250 which ejects the sheets stacked in the stacking section 220 to the outside of the stacking section 220, a slitter section 260 which cuts off margins at the both end portions in the width direction of the sheets ejected from the sheet ejection section 250, and such like. The intermediate conveyance apparatus 200 may further include a creasing section (creaser) for creasing the sheets stacked in the stacking section 220 and such like.

The receiving section 210 includes a pair of upper and lower receiving plates 211*a* and 211*b* which receives the sheets carried therein from the image forming apparatus 100, a pair of conveyance rollers 212*a* and 212*b* which conveys the received sheets by nipping the sheet therebetween, a switching gate 213 which switches the conveyance path of the sheets conveyed by the pair of conveyance roller 212*a* and 212*b* to a first conveyance path 201 or a second conveyance path 202, and such like.

The first conveyance path 201 is a conveyance path which guides the sheets downward and the second conveyance path 202 is a conveyance path which guides the sheets horizontally. The first conveyance path 201 and the second conveyance path 202 are provided so that the widths thereof in the Y direction are equal to or larger than the largest width in the Y direction of the conveyed sheets, and thus sheets in all the sizes handled in the image forming system 1 can pass through the first conveyance path 201 and the second conveyance path 202.

The sheets ejected from the image forming apparatus 100 are carried into the intermediate conveyance apparatus 200 via the pair of receiving plates 211*a* and 211*b* and nipped by the pair of conveyance rollers 212*a* and 212*b* driven by the driving section (not shown in the drawings) to be conveyed to the first conveyance path 201 or the second conveyance path 202 which is set by the switching gate 213.

When the conveyance path of the sheets is switched to the first conveyance path 201, the sheets are guided downward along the first conveyance path 201. Then, when the sheets are conveyed to a position where the rear end portions in the conveyance direction of the sheets being conveyed through the first conveyance path 201 are released from the nip by the pair of conveyance rollers 212*a* and 212*b*, the sheets freely fall downward toward the lower portion of the first conveyance path 201. The sheets fallen through the first conveyance path 201 fall to reach the first alignment section 230 provided at the lower portion of the first conveyance path 201, and the lower ends of the sheets are held by a stopper 231 (see FIG. 4, for example) of the first alignment section 230.

The stacking section 220 is a space which is formed at a portion of the first conveyance path 201 branched downward from the receiving section 210, and a predetermined number of sheets are stacked therein. The first alignment section 230 and the second alignment section 240 are provided in the space forming the stacking section 220.

Figure 4:
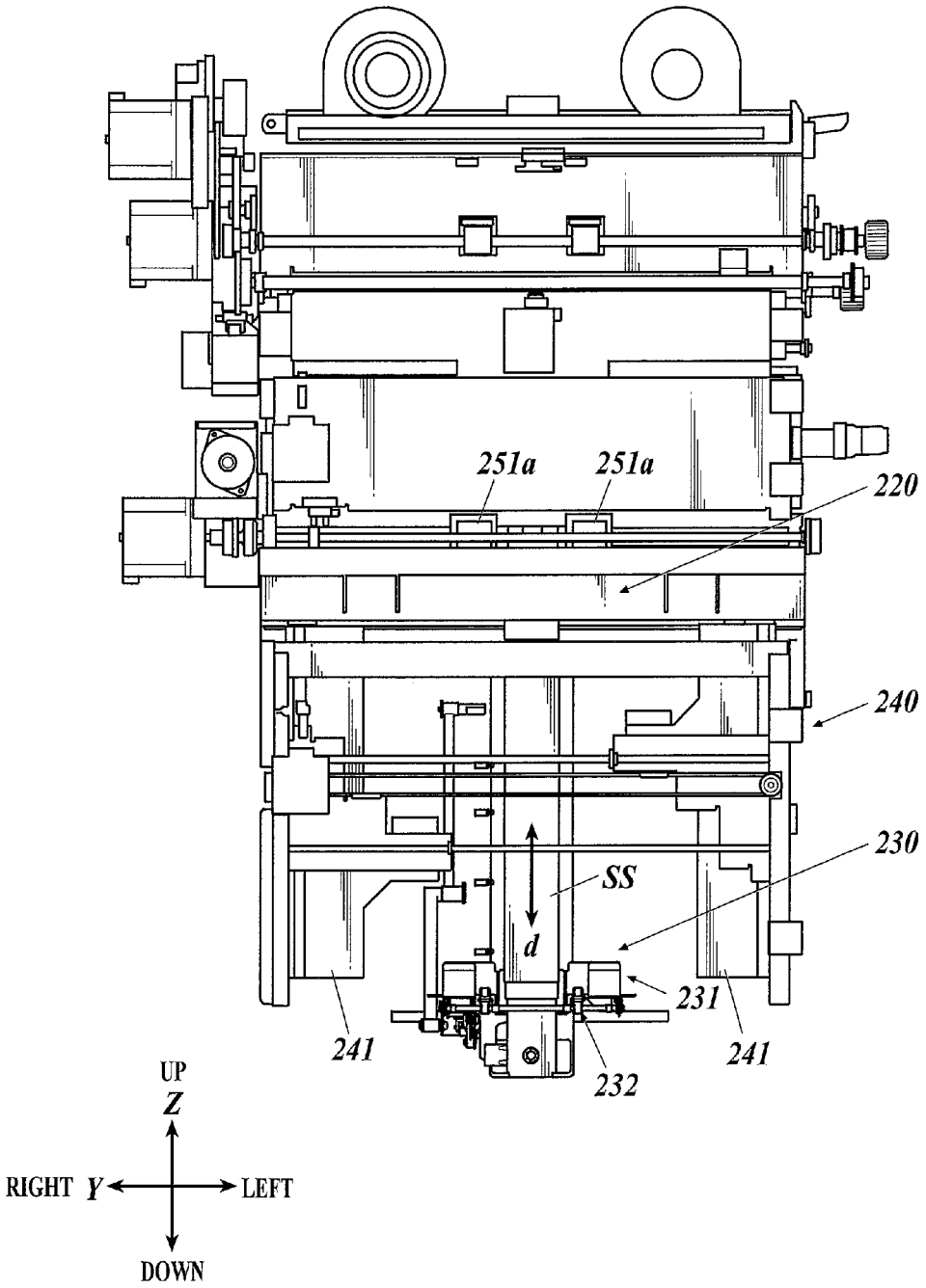
FIG. 4 is a plan view showing an example of a first alignment section and a second alignment section.
Figure 5:
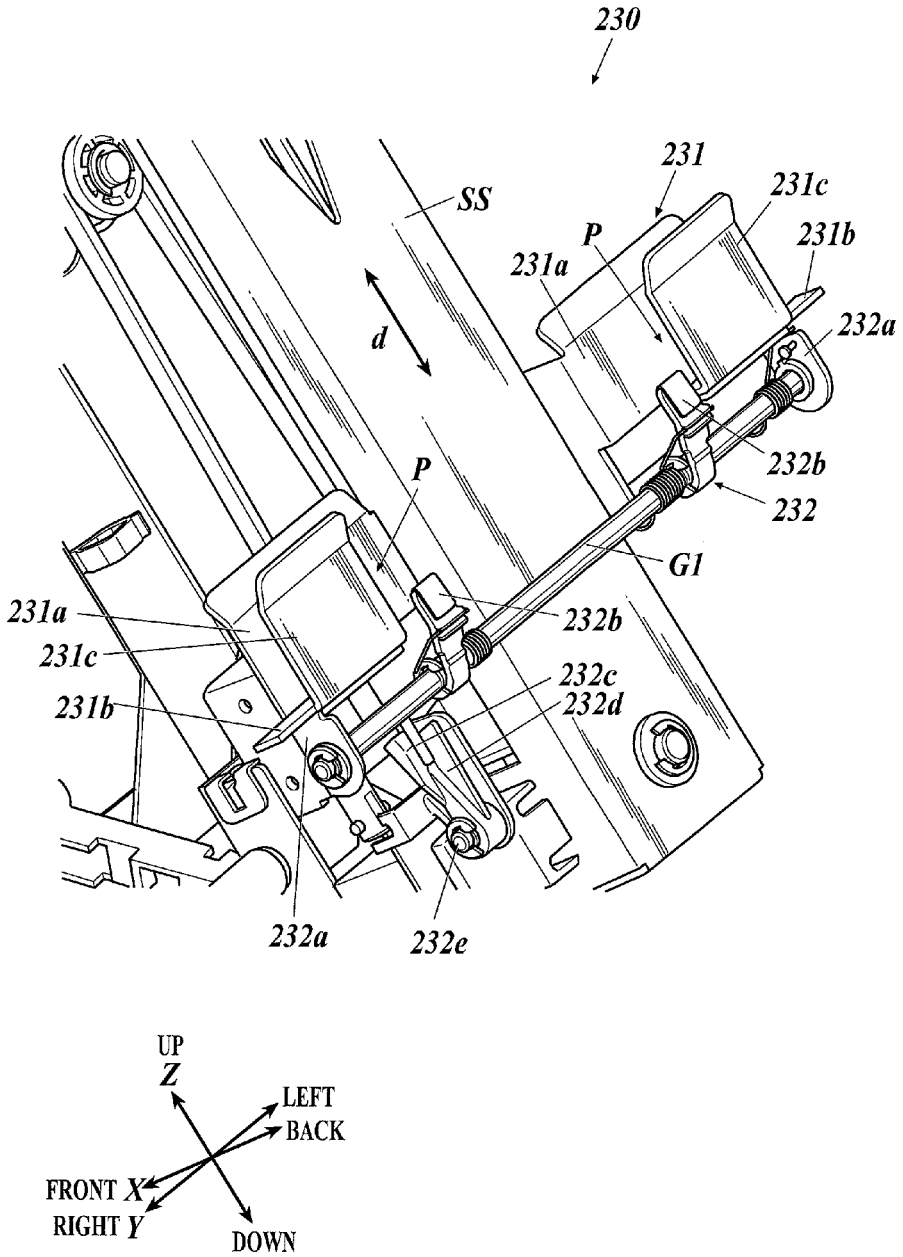
FIG. 5 is a perspective view showing an example of a configuration of main parts of the first alignment section.

FIG. 4 is a plan view showing an example of the stacking section 220, the first alignment section 230 and the second alignment section 240. FIG. 5 is a perspective view showing an example of a configuration of main parts of the first alignment section 230.

The number of sheets to be stacked is determined according to predetermined conditions such as a processing mode of sheet, the type of sheet and the basis weight of sheet, for example.

Specifically, when the saddle stitching, three-folding and the side stitching are set as the processing mode, the type of sheet to be processed is A4-size or smaller and the basis weight of sheet is 130 g/m$^2$ or less, for example, a plurality of (for example, three) sheets are to be stacked in the stacking section 220.

When the saddle stitching, three folding and side stitching are set as the processing modes, the type of sheet to be processed is larger than A4-size and the basis weight of sheet is larger than 130 g/m$^2$, for example, a plurality of (for example, two) sheets are to be stacked in the stacking section 220.

When trimming by the slitter section 260 is set as the processing mode, for example, a single sheet is to be stacked in the stacking section 220 regardless of the type and basis weight of the sheet.

The above correspondence relationship between the number of sheet to be stacked and the predetermined conditions is merely an example, and the present invention is not limited to this.

The first alignment section 230 performs vertical alignment in which the lower end of the sheet fallen through the first conveyance path 201 is gripped and the position of the lower end of the sheet is aligned.

Specifically, the first alignment section 230 includes a stopper (supporting section) 231, a gripping section 232, a driving section 233 (see FIG. 11) and such like.

The stopper 231 is formed so as to be movable in the direction of the arrow (d) in FIGS. 4 and 5 along a stopper supporting section SS which is long in the vertical direction where the upstream side in the sheet conveyance direction is the upper side and the downstream side in the sheet conveyance direction is the lower side.

The stopper supporting section SS is provided at a central position in the Y-direction of horizontal alignment plates 241 and 241 (described later) of the second alignment section 240 at the lower portion of the first conveyance path 201.

As shown in FIG. 5, the stopper 231 includes two first lateral sections 231*a* which are provided so as to face each other across the stopper supporting section SS so that the surfaces thereof are nearly parallel to the sheet surface, two bottom sections 231*b* which are provided so as to extend backward from the respective ends (lower ends) of the two first lateral sections 231*a* to be nearly orthogonal to the sheet surface, and two second lateral sections 231*c* which are provided so as to extend upward from the respective ends (back ends) of the two bottom sections 231*b* so that the surfaces thereof are nearly parallel to the plate surfaces of the first lateral sections 231*a*.

The second lateral sections 231*c* are formed to be smaller than the first lateral sections 231*a* in the Y-direction, and the end portions of the first lateral sections 231*a* near the stopper supporting section SS face after-mentioned grippers 232*b*.

The stopper 231 receives the sheet fallen from upstream in the first conveyance path 201 inside the space P formed of the first lateral sections 231*a*, the bottom sections 231*b* and the second lateral sections 231*c*, and holds the end portion in the conveyance direction (lower end portion) of the sheet against the bottom sections 231*b* to stop the sheet. Thereby, the position of the lower end in the conveyance direction of the sheet is aligned and the sheet is supported by the stopper 231. By aligning the position of the lower end of the sheet with the stopper 231 in such way, the position of the upper end is also aligned.

The gripping section 232 is provided in the stopper 231 to grip the central portion in the width direction of the sheet supported by the stopper 231.

Figure 6:
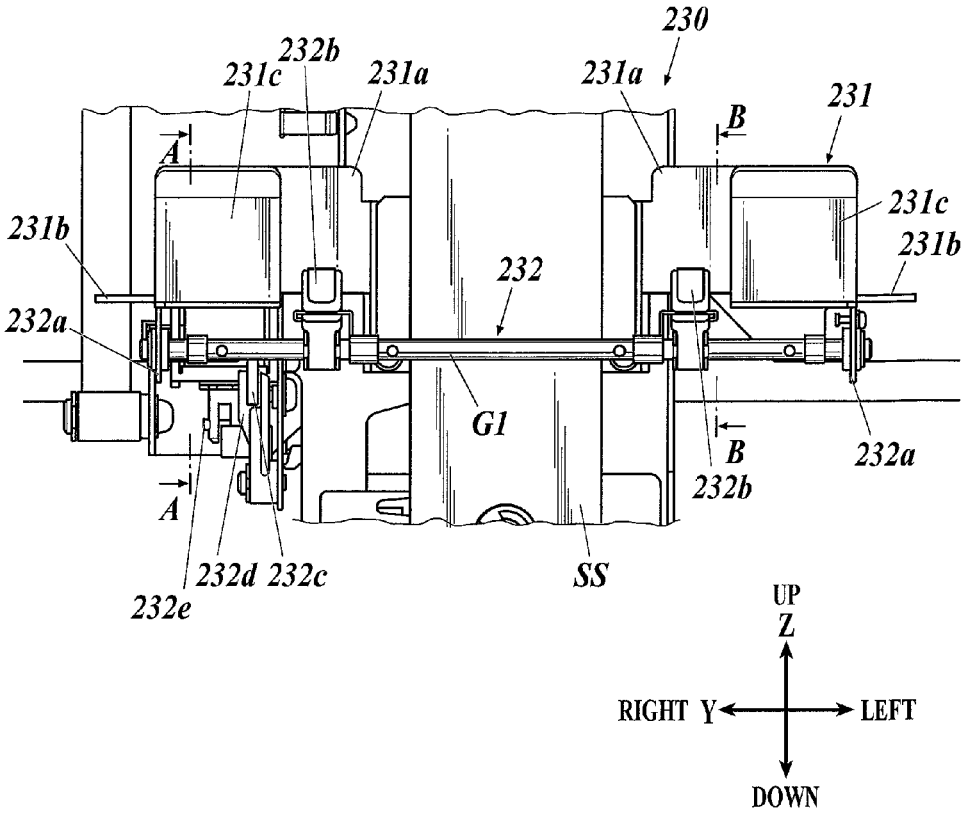
FIG. 6 is a plan view showing an example of a gripping section.
Figure 7:
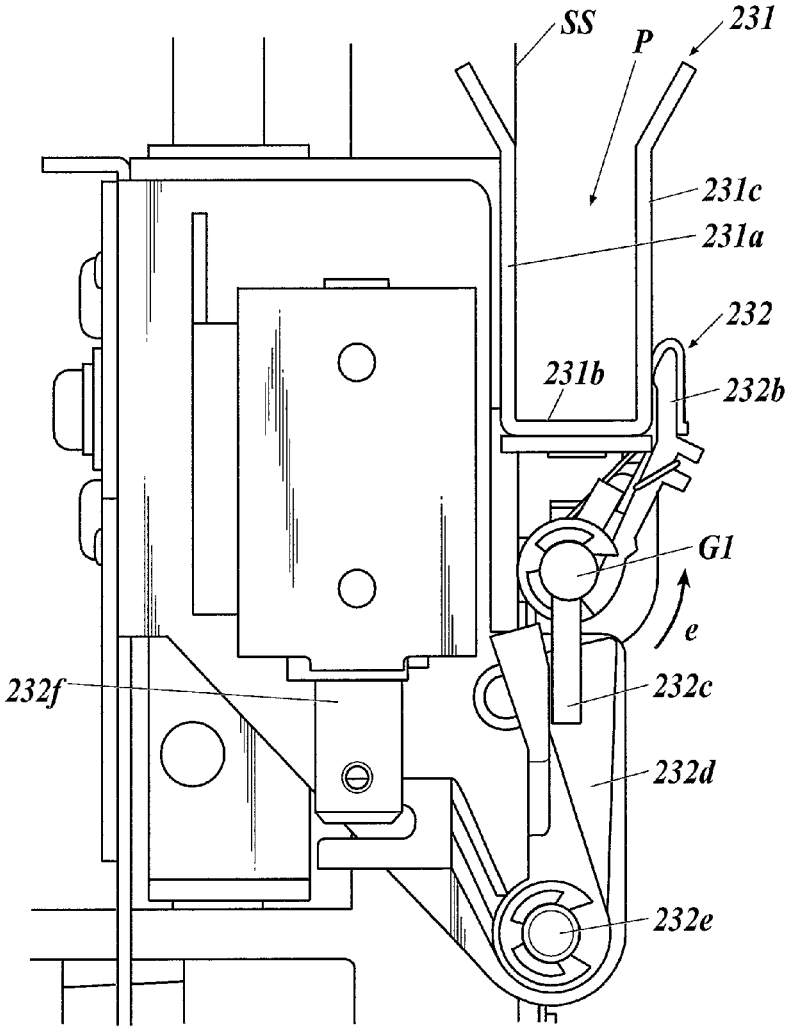
FIG. 7 is a sectional view of FIG. 6 cut along the line A-A, which shows a state where grip by the gripping section is released.
Figure 7:
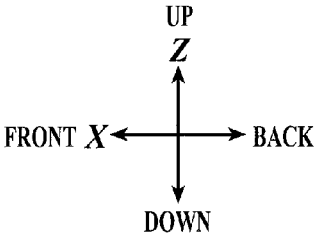
Figure 8:
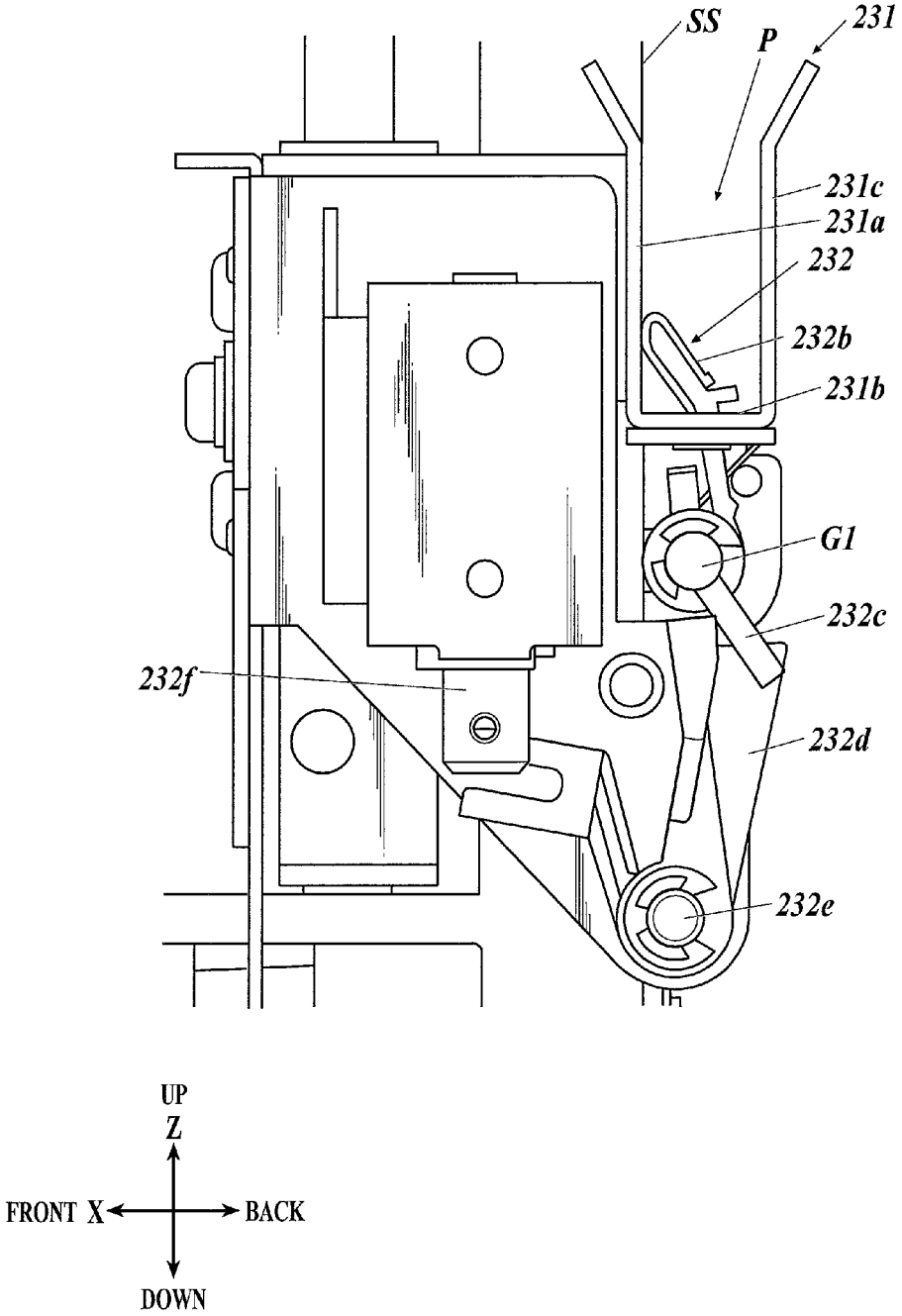
FIG. 8 is a sectional view of FIG. 6 cut along the line A-A, which shows a state where the gripping section is gripping a sheet.
Figure 9:
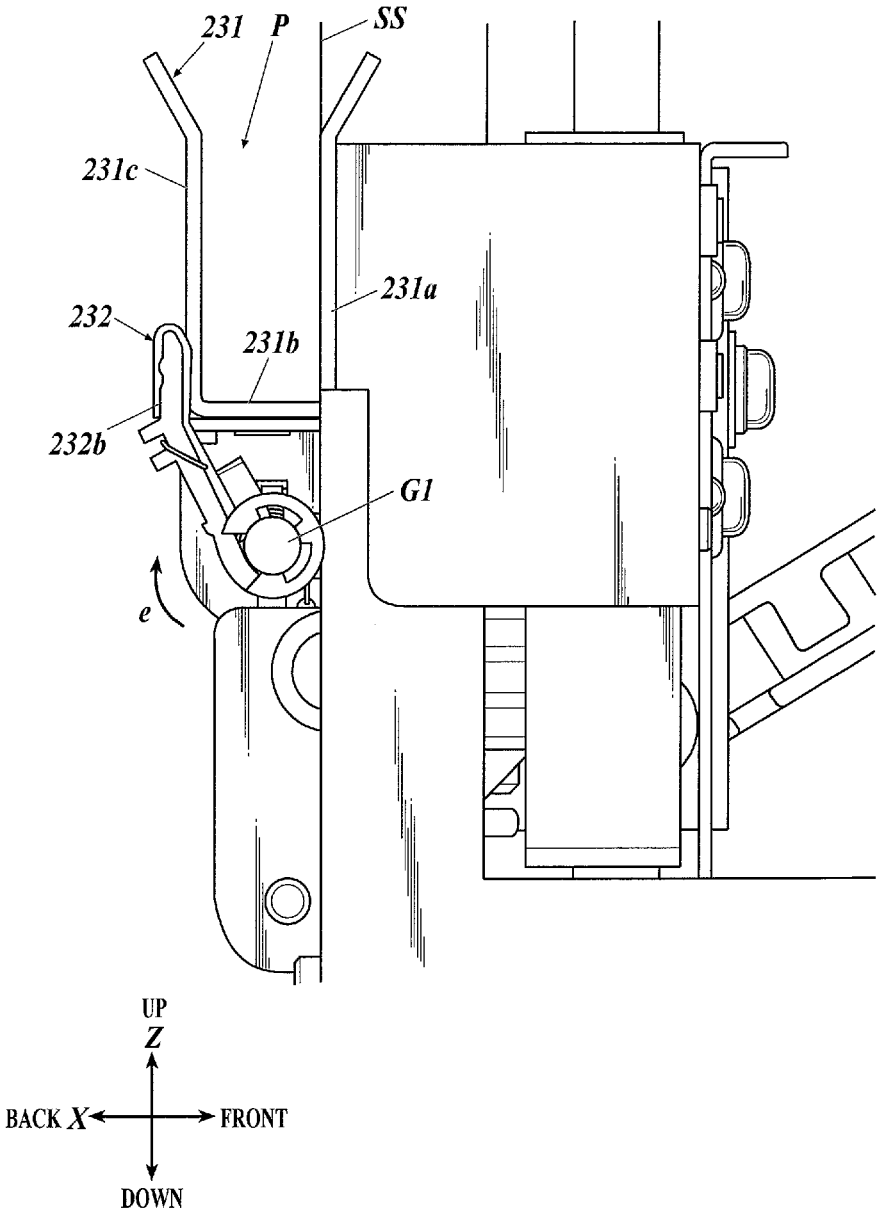
FIG. 9 is a sectional view of FIG. 6 cut along the line B-B, which shows a state where grip by the gripping section is released.
Figure 10:
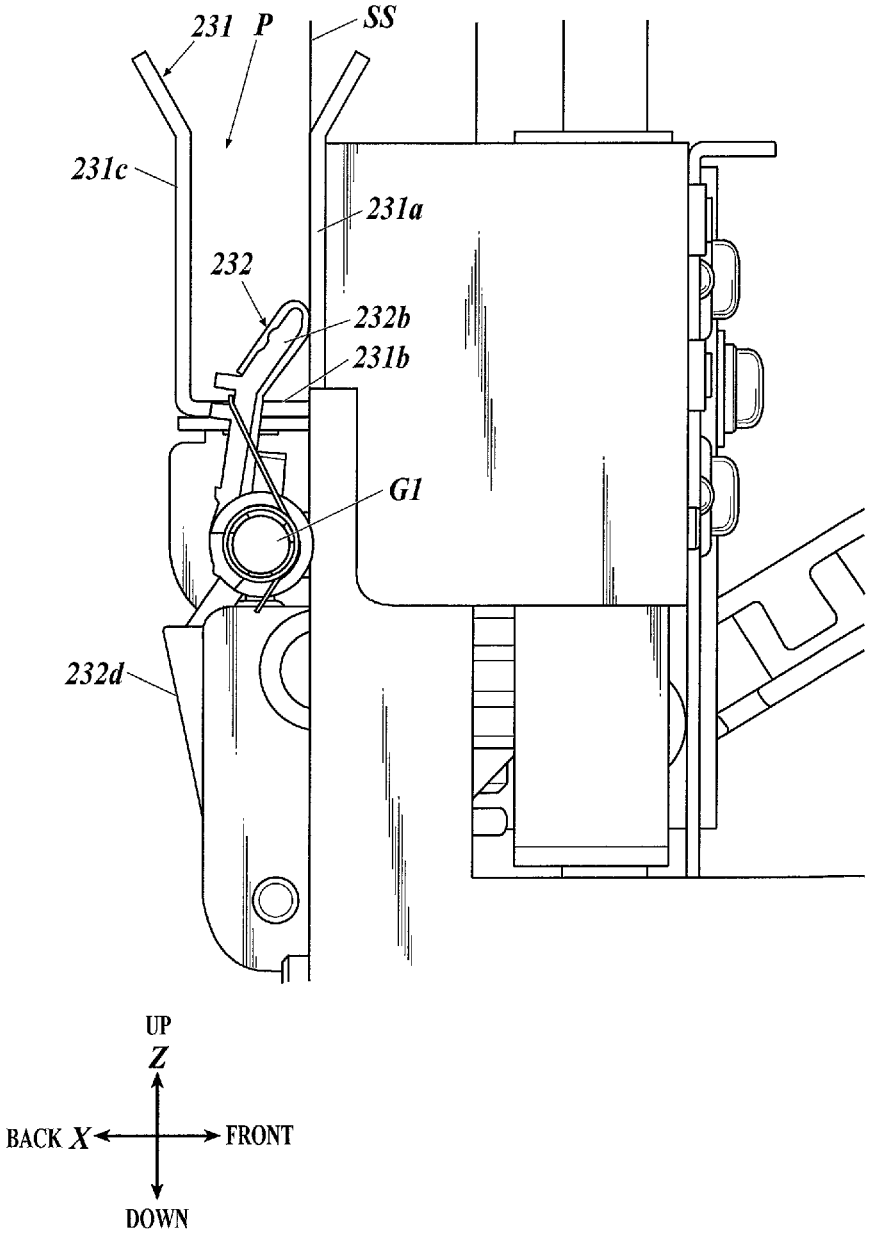
FIG. 10 is a sectional view of FIG. 6 cut along the line B-B, which shows a state where the gripping section is gripping a sheet.

Here, FIG. 6 is a plan view showing an example of the gripping section 232. FIG. 7 is a sectional view of FIG. 6 cut along the line A-A, showing a state where the grip of the gripping section 232 is released. FIG. 8 is a sectional view of FIG. 6 cut along the line A-A, showing a state where the gripping section 232 is gripping the sheet. FIG. 9 is a sectional view of FIG. 6 cut along the line B-B, showing a state where the grip of the gripping section 232 is released. FIG. 10 is a sectional view of FIG. 6 cut along the line B-B, showing a state where the gripping section 232 is gripping the sheet.

As shown in FIGS. 5 and 6, the gripping section 232 is supported by extension sections 232*a* extending downward from the lower end portions of the stopper 231. The gripping section 232 includes a pivot shaft G1 which is orthogonal to the sheet conveyance direction and extending along the direction (Y-direction) parallel to the sheet surface, two grippers 232*b* which are fixed with a predetermined interval therebetween on the pivot shaft G1, and such like.

The two grippers 232*b* are arranged at positions facing the respective end portions of the first lateral sections 231*a* near the stopper supporting section SS. That is, the two grippers 232*b* are arranged at positions facing the central portion in the width direction of the sheets when the sheets are supported by the stopper 231.

Then, as shown in FIGS. 7 and 9, the two grippers 232*b* which are located away from the first lateral sections 231*a* pivot in the direction of the arrow (e) in FIGS. 7 and 9 by the pivot shaft G1 pivoting forward and contact the first lateral sections 231*a* as shown in FIGS. 8 and 10. That is, when the sheets are supported in the space P, the two grippers 232*b* contact the sheet surface to grip the sheets with the first lateral sections 231*a*.

A protrusion 232*c* protruding along the diameter direction of the pivot shaft G1 is provided at the pivot shaft G1 so as to contact an end portion of a pressure lever 232*d*. The pressure lever 232*d* rotates around a rotating shaft 232*e* extending in a direction parallel to the pivot shaft G1, and presses the protrusion 232*c* contacting the end portion thereof. The pressure lever 232*d* is rotated by the drive of solenoid 232*f*.

The solenoid 232*f* is switched on and off by the control of the intermediate conveyance control section 504.

When the solenoid 232*f* is switched on, the pressure lever 232*d* rotates around the rotating shaft 232*e* so that the end portion thereof presses the protrusion 232*c* backward, and by the pivot shaft G1 pivoting in the direction of the arrow (e) in FIGS. 7 and 9, the grippers 232*b* also pivot in the direction of the arrow (e). Thus, the grippers 232*b* can grip the sheets with the first lateral sections 231*a* of the stopper 231 (see FIGS. 8 and 10).

Such sheet gripping operation by the two grippers 232*b* of the gripping section 232 is performed after the alignment in the sheet width direction to be described later is performed by the second alignment section 240.

That is, when the second alignment section 240 performs alignment in the sheet width direction, the solenoid 232*f* is turned on by the control of the intermediate conveyance control section 504, the grippers 232*b* rotate in the direction of the arrow (e), and thus the sheets which are aligned in the width direction are gripped between the grippers 232*b* and the first lateral sections 231*a* of the stopper 231.

When the solenoid 232*f* is turned off, since the pressure lever 232*d* rotates around the rotating shaft 232*e* so that the end portion thereof moves forward, the protrusion 232*c* following the pressure lever 232*d* also moves forward, and by the pivot shaft G1 pivoting in the opposite direction of the arrow (e) in FIGS. 7 and 9, the grippers 232*b* also rotate in the opposite direction of the arrow (e). Thus, the grippers 232*b* move away from the sheet surface to release the grip of the sheets (see FIGS. 7 and 9).

Such release of grip of the sheets by the two grippers 232*b* of the gripping section 232 is performed after the sheets are nipped by an after-mentioned pair of conveyance rollers 251*a* and 251*b*.

That is, when the pair of conveyance rollers 251*a* and 251*b* nips the sheets, the solenoid is turned off by the control of the intermediate conveyance control section 504, and the grippers 232*b* rotate in the direction opposite to the arrow (e) to release the grip of the sheets between the grippers 232*b* and the first lateral sections 231*a* of the stopper 231.

The driving section 233 moves, by the control of the intermediate conveyance control section 504, the stopper 231 in the direction of arrow (d) in FIGS. 4 and 5 along the stopper supporting section SS according to the size of the sheets to be stacked.

The second alignment section 240 contacts the both end portions of the sheets (i.e., both side edges in the Y-direction of the sheets) in the width direction orthogonal to the conveyance direction to align, in the width direction, the sheets which have been vertically aligned by the first alignment section 230.

Specifically, the second alignment section 240 includes horizontal alignment plates 241 and 241 which are provided so as to face each other along the Y-direction to sandwich, therebetween, the sheet that enters downward into the first conveyance path 201 by the fall, a driving section 242 (see FIG. 11) which drives the horizontal alignment plates 241 and 241, and such like.

The horizontal alignment plates 241 and 241 are provided so as to be driven by the driving section 242 to move toward or away from each other in the Y-direction.

The width alignment of the sheets is performed by the horizontal alignment plates 241 and 241 contacting the both ends (i.e., side edges) in the width direction of the sheets which enter the first conveyance path 201 and are gripped at the lower ends thereof by the stopper 231 of the first alignment section 230.

Here, in the second alignment section 240, in order to correspond to size difference in the width direction among individual sheets, the movement distance of the horizontal alignment plates 241 and 241 is controlled so that the left and right horizontal alignment plates 241 and 241 approach each other with a slightly smaller distance therebetween than a regular size in the width direction of the sheets.

Thus, the horizontal alignment plates 241 and 241 press the both end portions in the width direction of the sheets, which enables accurate width alignment.

The driving section 242 moves the horizontal alignment plates 241 and 241 symmetrically along the Y-direction by the control of the intermediate conveyance control section 504.

Such width alignment operation by the horizontal alignment plates 241 and 241 of the second alignment section 240 is performed after the lower ends in the conveyance direction of the sheets are aligned by the first alignment section 230.

That is, when the lower ends in the conveyance direction of the sheets are aligned by the first alignment section 230, the driving section 242 moves the horizontal alignment plates 241 and 241 along the Y-direction by the control of the intermediate conveyance control section 504 to align the sheets with the horizontal alignment plates 241 and 241.

The sheet ejection section 250 ejects the sheets stacked in the stacking section 220 at the timing when various types of processing (saddle stitching, three-folding, side stitching, trimming and the like) on the preceding sheets is completed.

The sheet ejection section 250 includes the pair of conveyance rollers 251*a* and 251*b*, a vertical pair of guide plates 252*a* and 252*b*, a pair of resist rollers 254 and 255, and such like.

As shown in FIG. 3, the pair of conveyance rollers 251*a* and 251*b* is provided so as to face each other to sandwich the sheets stacked in the stacking section 220 therebetween at a nearly central portion in the Z-direction of the first conveyance path 201.

The conveyance rollers 251*a* and 251*b* are located away from each other when the sheets enter the first conveyance path 201, and thus the entrance of the sheets is not disturbed.

When the sheets are ejected from the first conveyance path 201 by the drive of the driving section M1 (see FIG. 11), the pair of conveyance rollers 251*a* and 251*b* rotates in a state where the sheets are pressed therebetween to convey the sheets toward the guide plates 252*a* and 252*b*.

Specifically, when the width alignment is performed by the horizontal alignment plates 241 and 241 of the second alignment section 240 and further the grippers 232*b* grip the sheets to which the width alignment is performed, the pair of conveyance rollers 251*a* and 251*b* nips the gripped sheets. Then, when the grip by the grippers 232*b* is released, the pair of conveyance rollers 251*a* and 251*b* starts conveying the sheets.

The guide plate 252*a* is a plate which is fixed above the sheet conveyance path and is long along the Y-direction.

The guide plate 252*b* is a plate which is provided below the guide plate 252*a* at a position away from the guide plate 252*a* for a predetermined distance and is long along the Y-direction.

The sheets conveyed by the pair of conveyance rollers 251*a* and 251*b* are carried into a gap which is formed between the guide plate 252*a* and the guide plate 252*b*, nipped between the guide plate 252*a* and the guide plate 252*b*, and thereby conveyed downstream without losing the correct alignment thereof.

The pair of resist rollers 254 and 255 is provided downstream in the sheet conveyance direction of the pair of guide plates 252*a* and 252*b*.

In a case where the sheets are ejected one by one from the stacking section 220, by the drive of the driving section M2 (see FIG. 11), the pair of resist rollers 254 and 255 rotates in the opposite direction of the sheet conveyance direction so as to move against the sheet ejected from the stacking section 220 and thereby corrects the oblique position of each of the sheets.

That is, in a case where the sheets are ejected one by one from the stacking section 220, since the pair of resist rollers 254 and 255 rotates in the opposite direction of the sheet conveyance direction, the conveyed sheet stops with the end thereof contacting the pair of resist, rollers 254 and 255 without being drawn to the gap between the pair of resist rollers 254 and 255. Thus, the oblique position is corrected if each of the sheets is oblique due to the conveyance until then.

After correcting the oblique position of the sheet by rotating in the opposite direction of the sheet conveyance direction, the pair of resist rollers 254 and 255 rotates in the forward direction of the sheet conveyance direction by the drive of the driving section M2, and starts conveying the sheet of which oblique position is corrected. Thus, each of the sheets of which oblique position is corrected can be conveyed downstream.

In a case where a pile of a plurality of sheets is ejected from the stacking section 220, the pair of resist rollers 254 and 255 rotates in the forward direction of the sheet conveyance direction by the drive of the driving section M2.

That is, if a pile of a plurality of sheets is ejected from the stacking section 220, since the pair of resist rollers 254 and 255 rotates in the forward direction of the sheet conveyance direction, the sheets can be rapidly conveyed downstream.

The slitter section 260 is provided downstream of the pair of resist rollers 254 and 255 in the sheet conveyance direction, and includes slitter blades (trimming unit) 261 and 262 which cut off margins of the both end portions in the width direction of the sheets conveyed by the forward rotation of the pair of resist rollers, and a trash box 263 which contains the margins that are cut off.

The slitter blades 261 and 262 are disk-shaped blades which are provided at positions so as to face each other to vertically sandwich the passage (conveyance path) of the sheets passing through the slitter section 260, and provided so that the disk surfaces are arranged along the Z-plane.

The slitter blades 261 and 262 rotate in the opposite direction of each other at the same speed around the rotation shafts 261*a* and 262*a*, respectively, by the drive of the driving section M3 (see FIG. 11) so as to engage each other in the Y-direction.

Specifically, the slitter blades 261 and 262 are provided so as to be adjacent to each other in a staggered manner in the Y-direction, and the sheets are cut off between the adjacent slitter blades 261 and 262.

The pair of the slitter blades 261 and 262 is provided at each of the lateral end portions in the conveyance path of the sheets (both lateral portions in the Y-direction), and the two pairs of slitter blades 261 and 262 perform the same operation.

Further, the two pairs of slitter blades 261 and 262 are movable in the Y-direction and the distance therebetween can be appropriately changed according to the width of the conveyed sheets.

The sheets in which the margins are cut off by the slitter blades 261 and 262 are passed to the saddle stitching apparatus 300. The margins which were cut off fall down to the trash box 263 which is set below the slitter blades 261 and 262.

The trash box 263 is a box which is set below the slitter blades 261 and 262 with the upper surface open, and contains the margins which were cut off by the slitter blades 261 and 262 and fell down. The trash box 263 can be removed from the intermediate conveyance apparatus 200, and the contents contained therein are wasted by the user removing the trash box 263 at an arbitrary timing.

Returning to FIG. 1, the saddle stitching apparatus 300 performs double-folding that is double-folding sheets (folding sheets in half), saddle stitching that is overlying a predetermined number of the double-folded sheets each other and stitching them to make a saddle-stitched booklet, edge trimming that is trimming edges of the saddle-stitched booklet, and such like.

Specifically, the saddle stitching apparatus 300 includes a double folding section 310 which double-folds, along the Y-direction, the sheets that are passed from the intermediate conveyance apparatus 200, an ejection mechanism 320 which ejects the double-folded sheets along the Y-direction, a stacking section 330 which stacks the sheets ejected from the ejection mechanism 320, a saddle stitching section 340 which strikes staples on the folding line of the sheets to form a saddle-stitched booklet after a predetermined number of sheets are stacked in the stacking section 330, a trimming section 350 which trims the edge portions of the saddle-stitched booklet which is formed, an ejection section 360 which ejects the saddle-stitched booklet in which the edges are trimmed, and such like.

Also, the saddle stitching apparatus 300 can pass the sheets passed from the intermediate conveyance apparatus 200 to the side stitching apparatus 400 without performing a part or all of the various processing by the saddle-stitching apparatus 300. The saddle stitching apparatus 300 may further include a processing section for performing square folding which forms a spine of the saddle-stitched booklet.

The side stitching apparatus 400 performs side stitching and such like on a plurality of sheets.

Specifically, the side stitching apparatus 400 includes, for example, a stapling section which performs stapling on a plurality of sheets passed from the saddle stitching apparatus 300, a page edge trimming section which performs edge trimming that is trimming portions of the end parts of the plurality of stapled sheets so as to align the end parts parallel to the spine, and an ejection section which ejects the sheets which were processed by the connected apparatuses.

The side stitching apparatus 400 can eject the sheets passed from the saddle stitching apparatus 300 without performing a part or all of the various processing by the side stitching apparatus 400.

Next, operation control of the image forming system 1 will be described.

Figure 11:
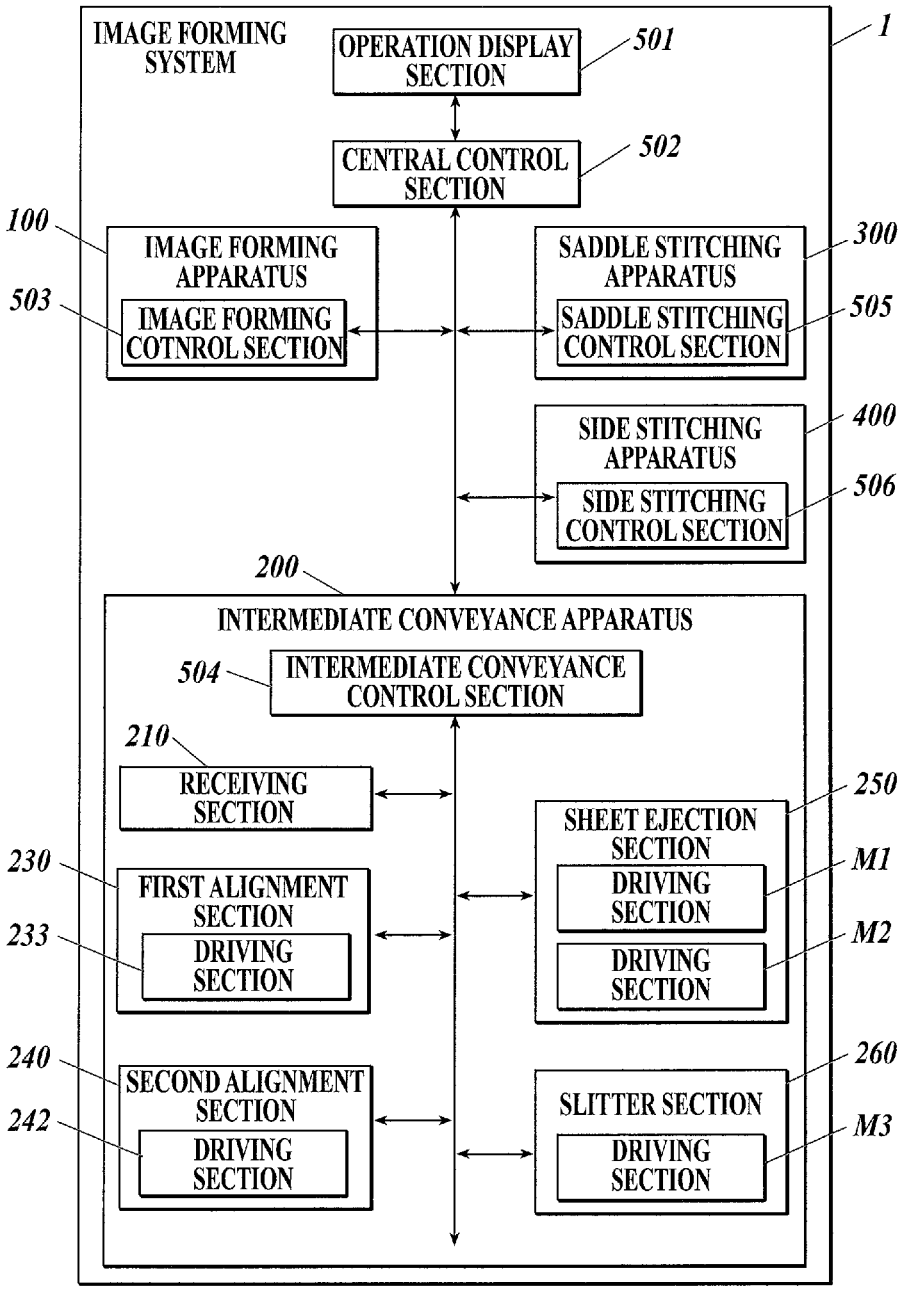
FIG. 11 is a block diagram showing a main configuration according to an operation control of the image forming system.

FIG. 11 is a block diagram showing a main configuration according to the operation control of the image forming system 1.

The image forming system 1 includes an operation display section 501 which receives input operation of a user according to the operation of the image forming system 1 and performs display output according to the operation of the image forming system 1, a central control section 502 which performs operation control of the entire image forming system 1, an image forming control section 503 which performs operation control of the image forming apparatus 100, an intermediate conveyance control section 504 which performs operation control of the intermediate conveyance apparatus 200, a saddle stitching control section 505 which performs operation control of the saddle stitching apparatus 300 and a side stitching control section 506 which performs operation control of the side stitching apparatus 400.

The operation display section 501, for example, includes an operation display device which is touch panel type and switches, keys and such like for inputting various input, and sends a signal according to the contents input by the user to the central control section 502.

Each of the central control section 502, the image forming control section 503, the intermediate conveyance control section 504, the saddle stitching control section 505 and the side stitching control section 506 includes a CPU, a RAM, a ROM and such like and reads out software programs and various data according to the contents of the processing to perform the processing.

The central control section 502 sets various conditions according to the image forming system 1 corresponding to the input contents of the user which were input via the operation display section 501. Then, the central control section 502 outputs an instruction for performing processing according to the set contents to the respective control sections of the image forming control section 503, the intermediate conveyance control section 504, the saddle stitching control section 505 and the side stitching control section 506. The control sections control the operations of the respective apparatuses to be controlled according to the instruction.

Hereinafter, the sheet gripping operation by the two grippers 232*b* in the intermediate conveyance apparatus 200 by the control of the intermediate conveyance control section 504 will be described.

Figure 12:
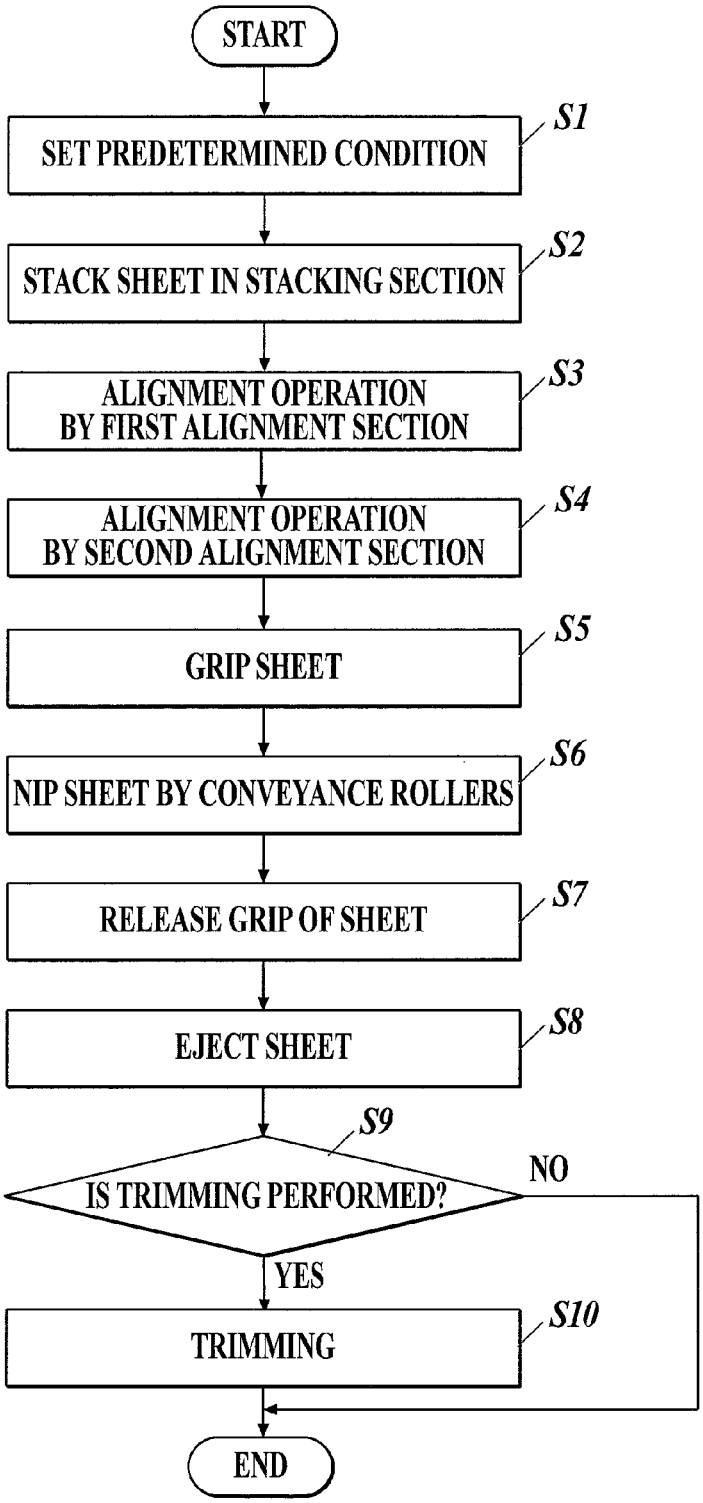
FIG. 12 is a flowchart showing a sheet gripping operation of the gripping section in the intermediate conveyance apparatus.

FIG. 12 is a flowchart showing the sheet gripping operation by the two grippers 232*b*.

First, in step S1, predetermined conditions regarding the operation of the intermediate conveyance apparatus 200 are set by the user operating the operation display section 501.

Here, the predetermined conditions include the type and basis weight of sheets on which images are to be formed and a processing mode, for example. As the processing mode, for example, whether to stack sheets in the intermediate conveyance apparatus 200, whether to trim margins of the both side portions in the sheet conveyance direction, and the width of the margins to be trimmed are set.

Next, in step S2, the intermediate conveyance control section 504 stacks a predetermined number of sheets which were passed via the receiving section 210 from the image forming apparatus 100 in the stacking section 220.

Specifically, in a case where the saddle stitching, three-folding and side stitching are set as the processing modes, the intermediate conveyance control section 504 stacks a predetermined number (for example, two or three) of sheets in the stacking section 220, for example.

In a case where trimming by the slitter section 260 is set to be performed as the processing mode, the intermediate conveyance control section 504 stacks the sheets one by one in the stacking section 220, for example.

At that time, the intermediate conveyance control section 504 drives the driving section 233 so as to move the stopper 231 in the direction of arrow (d) in FIGS. 4 and 5 along the stopper supporting section SS according to the size of the sheets to be stacked.

In step S3, the intermediate conveyance control section 504 performs vertical alignment by the first alignment section 230 to the sheets stacked in the stacking section 220.

Specifically, the stopper 231 receives the sheets fallen from upstream in the first conveyance path 201 inside the space P which is formed of the first lateral sections 231*a*, the bottom sections 231*b* and the second lateral sections 231*c*, and the end portions (lower end portions) in the conveyance direction of the sheets are held against the bottom sections 231*b* to stop the sheets.

Then, in step S4, the intermediate conveyance control section 504 performs horizontal alignment by the second alignment section 240 to the sheets which are vertically aligned.

Specifically, the intermediate conveyance control section 504 drives the driving section 242 so as to move the horizontal alignment plates 241 and 241 along the Y-direction toward each other and presses the both end portions in the width direction of the sheets with the horizontal alignment plates 241 and 241. Thus, even when there is a gap in the sheet width, the width alignment can be performed surely.

In step S5, the intermediate conveyance control section 504 turns on the solenoid 232*f* to rotate the grippers 232*b* in the direction of arrow (e) in FIGS. 7 and 9, and grips the central portions in the width direction of the sheets which are aligned in the width direction between the first lateral sections 231*a* of the stopper 231 and the grippers 232*b*.

At that time, since the grippers 232*b* are provided at positions facing the central portions in the width direction of the sheets, the central portions in the width direction of the sheets can be surely gripped even when a warp occurs by the central portions in the width direction of the sheets being raised compared to the end portions due to the pressure applied at the horizontal alignment in the above step S4, for example.

In step S6, the intermediate conveyance control section 504 drives the pair of conveyance rollers 251*a* and 251*b* to nip the sheets which are gripped.

In step S7, the intermediate conveyance control section 504 turns off the solenoid 232*f* to rotate the grippers 232*b* in the opposite direction of the direction of arrow (e) in FIGS. 7 and 9 to release the grip of the sheets.

Then, since the gripped sheets are nipped in the above step S6, it is possible to prevent a trouble that the sheets bounce due to the rebound when the grip of the sheets is released and the central portions in the width direction of the sheets shift from the central portion in the width direction of the conveyance path.

In step S8, the intermediate conveyance control section 504 ejects the sheets.

Specifically, the intermediate conveyance control section 504 drives the pair of conveyance rollers 251*a* and 251*b* to convey the sheets and ejects the sheets outside the stacking section 220 via the guide plates 252*a* and 252*b*.

In step S9, the intermediate conveyance control section 504 determines whether trimming by the slitter section 260 is set to be performed, and if the trimming is not set to be performed (step S9: NO), the processing ends. On the other hand, if the trimming is set to be performed (step S9: YES), the slitter section 260 trims the margins of the both end portions in the width direction of the sheets ejected from the guide plates 252*a* and 252*b* in the following step S10, and the processing ends.

Specifically, in a case where the saddle stitching, three-folding and side stitching are set as the processing modes and a plurality of sheets are to be ejected from the stacking section 220, for example, the intermediate conveyance control section 504 rotates the pair of resist rollers 254 and 255 in the forward direction. Thus, the pile of plurality of sheets which are ejected are conveyed downstream along the conveyance path.

On the other hand, in a case where trimming by the slitter section 260 is set as the processing mode and the sheets are to be ejected from the stacking section 220 one by one, for example, the intermediate conveyance control section 504 rotates the pair of resist rollers 254 and 255 in the opposite direction. Thus, the sheets which are ejected one by one contact the pair of resist rollers 254 and 255 to stop, and the oblique position thereof is corrected. Then, the intermediate conveyance control section 504 rotates the pair of resist rollers 254 and 255 in the forward direction to convey the sheet in which the oblique position is corrected downstream, and thereafter, trims the margins of the both end portions in the width direction of the sheets with the slitter section 260.

Here, in a case where the slitter section 260 performs trimming, since the operations by the sections in the above steps S5 to S7 prevent the central positions in the width direction of the sheets to which width alignment is performed from shifting from the central position in the width direction of the conveyance path, the trimming can be accurately performed.

As described above, according to the embodiment, the intermediate conveyance apparatus 200 includes the first alignment section 230, the second alignment section 240 and the intermediate conveyance control section 504. The first alignment section 230 includes the stopper 231 which supports the lower end portions in the conveyance direction of the sheets and the gripping section 232 which grips the sheets at the central portions in the width direction of the sheets supported by the stopper 231. The second alignment section 240 includes the pair of horizontal alignment plates 241 and 241 which are provided at positions facing each other along the width direction to sandwich the sheets supported by the stopper 231 and which move along the width direction to contact or move away from the both end portions in the width direction of the sheets supported by the stopper 231. The intermediate conveyance control section 504 moves the pair of horizontal alignment plates 241 and 241 away from the both end portions in the width direction of the sheets after gripping the sheets by operating the gripping section 232 in a state where the pair of the horizontal alignment plates 241 and 241 contact the both end portions in the with direction of the sheets supported by the stopper 231.

Thus, since the central portions in the width direction of the sheets are gripped when the pair of horizontal alignment plates 241 and 241 move away from the sheets after the width alignment operation, it is possible to prevent the central positions in the width direction of the sheets from shifting from the central position in the width direction of the conveyance direction due to the rebound when the pair of horizontal alignment plates 241 and 241 moves away from the sheets.

Further, according to the embodiment, the sheet ejection section 250 includes the pair of conveyance rollers 251*a* and 251*b* which convey the sheets stacked in the stacking section 220 outside the stacking section 220, and the intermediate conveyance control section 504 releases the grip of the gripping section 232 after the sheets gripped by the gripping section 232 are nipped by the pair of conveyance rollers 251*a* and 251*b*.

Thus, since the sheets are nipped by the pair of conveyance rollers 251*a* and 251*b* in a state where the central portions in the width direction of the sheets are gripped, the conveyance can be started without shifting the central positions in the width direction of the sheets from the central position in the width direction of the conveyance path even when the grip of the gripping section 232 is released.

In addition, according to the embodiment, the slitter blades 261 and 262 which trim the margins of the both end portions in the width direction of the conveyed sheets are provided downstream in the sheet conveyance direction of the sheet ejection section 250.

Thus, the margins can be trimmed by the slitter blades 261 and 262 for the conveyed sheets without shifting the central positions in the width direction of the sheets from the central position in the width direction of the conveyance path, which enables accurate trimming.

The number and shape of the grippers 232*b* are not limited to the above embodiment as long as the sheets can be gripped at the central portions in the width direction of the sheets supported by the stopper 231.

Figure 13:
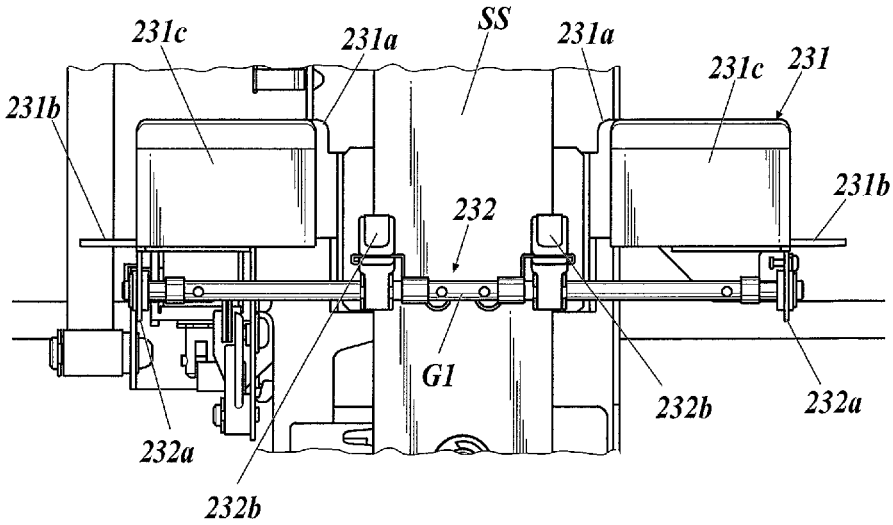
FIG. 13 is a plan view showing a modification example of the gripping section.

For example, though the above embodiment has been described by illustrating, as an example, a configuration where the grippers 232*b* are provided at positions facing the end portions of the first lateral sections 231*a* which are near the stopper supporting section SS, alternatively, the grippers 232*b* may be provided at positions overlapping the side end portions of the stopper supporting section SS as shown in FIG. 13. In such case, it is also preferable that the width of the second lateral sections 231*c* in the Y-direction is broadened.

Also, though not shown in the drawings, it goes without saying that three or more grippers 232*b* can be provided.

Also, only one gripper 232*b* can be provided at a position facing the center in the width direction (Y-direction) of the pair of horizontal alignment plates 241 and 241.

Figure 14:
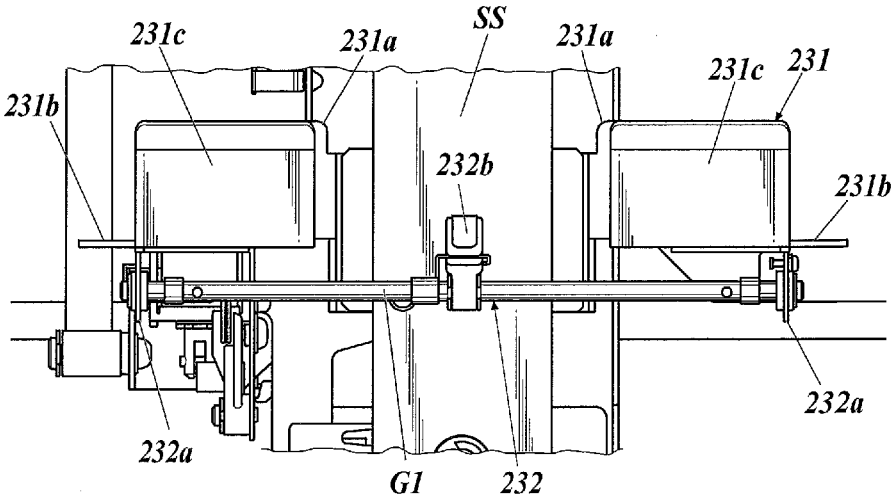
FIG. 14 is a plan view showing a modification example of the gripping section.

Specifically, for example, as shown in FIG. 14, the gripper 232*b* can be provided at a position overlapping the center in the Y-direction of the stopper supporting section SS. In such case, it is also preferable that the size in the Y-direction of the gripper 232*b* is broadened as shown in FIG. 15.

Figure 15:
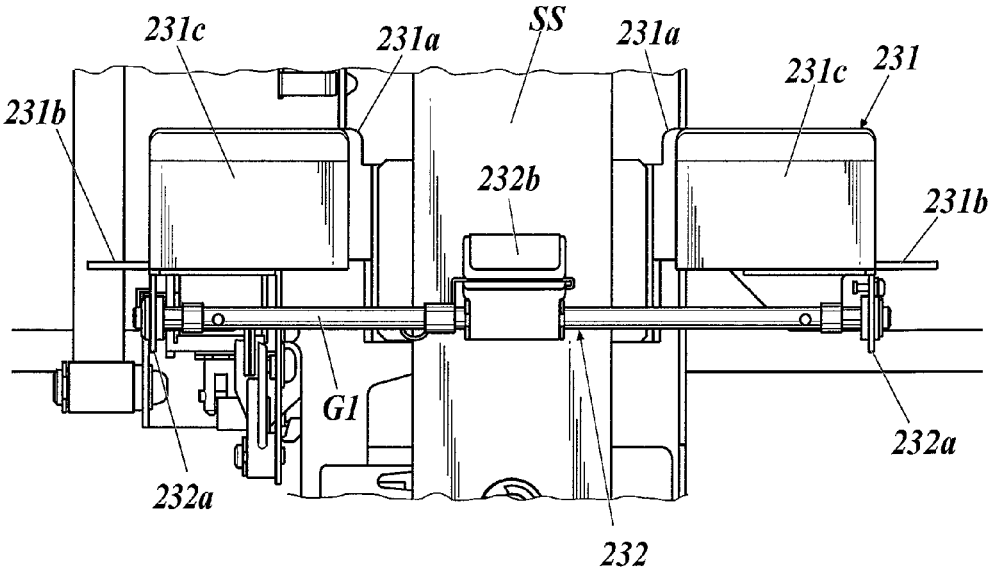
FIG. 15 is a plan view showing a modification example of the gripping section.

In a case of the configurations as in FIGS. 14 and 15, since the gripper 232*b* can face the center in the width direction of the sheets, the center in the width direction of the sheets can be surely gripped, and thus it is possible to surely prevent the central positions in the width direction of the sheets from shifting from the central position in the width direction of the conveyance path after the width alignment operation.

In addition, though the embodiment has been described by illustrating, as an example, the configuration where the grippers 232*b* as the gripping section grip the sheets with the first lateral sections 231*a*, the configuration of the gripping section is not limited to this as long as the sheets supported by the stopper 231 can be gripped at the front surface and the back surface of the sheets.

Though the embodiment has been described by illustrating, as an example, a configuration where the grippers 232*b* are rotated by the solenoid 232*f*, various types of driving motors or such like may be included instead of the solenoid.

Though the embodiment has been described by illustrating, as an example, the configuration where the intermediate conveyance apparatus 200 includes the pair of resist rollers 254 and 255 and the slitter section 260, there may be a configuration which does not include them in a case where trimming is not to be performed. Even in such case, by performing the gripping operation of the embodiment, stable sheet conveyance to the saddle stitching apparatus 300 and the side stitching apparatus 400 can be achieved.

Though the embodiment has been described by illustrating, as an example, a configuration where the width alignment is performed by the second alignment section 240 after the vertical alignment by the first alignment section 230 is finished, the vertical alignment and the width alignment can be performed at the same time.

Though the embodiment has been described by illustrating, as an example, the configuration where the sheets which are conveyed from the image forming apparatus 1 are stacked as the "sheets conveyed from upstream" in the stacking section 220, for example, sheets conveyed from an arbitrary processing section may be stacked in the stacking section 220 by providing the processing section between the receiving section 210 and the stacking section 220 of the intermediate conveyance apparatus 200. Also, the sheets conveyed from an apparatus other than the image forming apparatus 1 may be stacked in the stacking section 220.

The entire disclosure of Japanese Patent Application No. 2012-282096 filed on Dec. 26, 2012 including description, claims, drawings, and abstract are incorporated herein by reference in its entirety.

What is claimed is:

1. A sheet processing apparatus comprising:

a stacking section in which at least one sheet of paper conveyed from upstream is stacked;

a first alignment section which aligns both end portions of the at least one sheet in a sheet conveyance direction of the at least one sheet stacked in the stacking section, the sheet conveyance direction being a direction in which the at least one sheet is conveyed to the stacking section;

a second alignment section which aligns both end portions of the at least one sheet in a width direction of the at least one sheet aligned by the first alignment section, the width direction being orthogonal to the sheet conveyance direction;

a sheet ejection section which ejects the at least one sheet stacked in the stacking section to outside of the stacking section;

a gripping section which grips the at least one sheet at a central portion in the width direction of the at least one sheet supported by a supporting section; and a control section which controls to move a pair of horizontal alignment plates away from the both end portions of the at least one sheet in the width direction of the at least one sheet after operating the gripping section to grip the at least one sheet in a state in which the pair of horizontal alignment plates contact the both end portions of the at least one sheet in the width direction of the at least one sheet, while the at least one sheet is supported by the supporting section, wherein the first alignment section includes the supporting section which supports a downstream end portion of the at least one sheet in the sheet conveyance direction, wherein the second alignment section includes the pair of horizontal alignment plates which are provided at positions facing each other so as to sandwich, along the width direction, the at least one sheet supported by the supporting section, the pair of horizontal alignment plates being movable along the width direction to contact and move away from the both end portions of the at least one sheet in the width direction of the at least one sheet supported by the supporting section, and wherein the sheet ejection section includes a pair of conveyance rollers which convey the at least one sheet stacked in the stacking section to outside of the stacking section, and the control section controls to release a grip of the gripping section after the pair of conveyance rollers nips the at least one sheet which is gripped by the gripping section.

2. The sheet processing apparatus of claim 1, wherein a trimming unit which trims margins at the both end portions of the at least one sheet in the width direction of the at least one sheet having been conveyed is provided downstream of the sheet ejection section in a direction in which the at least one sheet is conveyed to the sheet ejection section.

3. The sheet processing apparatus of claim 1, wherein the gripping section is provided at a position facing a center of the pair of horizontal alignment plates in the width direction.

4. The sheet processing apparatus of claim 1, wherein the gripping section comprises a plurality of gripping units provided at positions facing a central portion of the pair of horizontal alignment plates in the width direction.

5. An image forming system, comprising:

an image forming apparatus; and the sheet processing apparatus of claim 1 which performs predetermined processing on the at least one sheet on which an image is formed by the image forming apparatus.

6. A sheet processing apparatus comprising:

a stacking section in which at least one sheet of paper conveyed from upstream is stacked;

a first alignment section which aligns both end portions of the at least one sheet in a sheet conveyance direction of the at least one sheet stacked in the stacking section, the sheet conveyance direction being a direction in which the at least one sheet is conveyed to the stacking section;

a second alignment section which aligns both end portions of the at least one sheet in a width direction of the at least one sheet aligned by the first alignment section, the width direction being orthogonal to the sheet conveyance direction;

a sheet ejection section which ejects the at least one sheet stacked in the stacking section to outside of the stacking section;

a gripping section which grips the at least one sheet at a central portion in the width direction of the at least one sheet supported by a supporting section; and a control section which controls to move a pair of horizontal alignment plates away from the both end portions of the at least one sheet in the width direction of the at least one sheet after operating the gripping section to grip the at least one sheet in a state in which the pair of horizontal alignment plates contact the both end portions of the at least one sheet in the width direction of the at least one sheet, while the at least one sheet is supported by the supporting section, wherein the first alignment section includes the supporting section which supports a downstream end portion of the at least one sheet in the sheet conveyance direction, wherein the second alignment section includes the pair of horizontal alignment plates which are provided at positions facing each other so as to sandwich, along the width direction, the at least one sheet supported by the supporting section, the pair of horizontal alignment plates being movable along the width direction to contact and move away from the both end portions of the at least one sheet in the width direction of the at least one sheet supported by the supporting section, and wherein the gripping section is provided in the first alignment section and grips the downstream end portion of the at least one sheet in the sheet conveyance direction.

* * * * *